US009853391B2

(12) United States Patent
Spencer et al.

(10) Patent No.: US 9,853,391 B2
(45) Date of Patent: Dec. 26, 2017

(54) WIRE CONNECTOR WITH INTEGRATED COAXIAL CONNECTION AND FRONT LOADED TERMINAL POSITION ASSURANCE STRUCTURES

(71) Applicant: Sumitomo Wiring Systems, Ltd., Yokkaichi, Mie (JP)

(72) Inventors: Martin Spencer, Farmington Hills, MI (US); Brian Nagy, Woodhaven, MI (US); Joseph Lanzotti, Grosse Pointe, MI (US); Norihiko Tanigawa, Farmington Hills, MI (US)

(73) Assignee: Sumitomo Wiring Systems, Ltd., Yokkaichi, Mie (JP)

( * ) Notice: Subject to any disclaimer, the term of this patent is extended or adjusted under 35 U.S.C. 154(b) by 0 days.

(21) Appl. No.: 15/254,606

(22) Filed: Sep. 1, 2016

(65) Prior Publication Data

US 2017/0063003 A1 Mar. 2, 2017

Related U.S. Application Data

(60) Provisional application No. 62/212,914, filed on Sep. 1, 2015.

(51) Int. Cl.

| | |
|---|---|
| ***H01R 13/28*** | (2006.01) |
| ***H01R 13/514*** | (2006.01) |
| ***H01R 13/436*** | (2006.01) |
| *H01R 13/422* | (2006.01) |
| *H01R 13/52* | (2006.01) |

(52) U.S. Cl.

CPC ..... *H01R 13/514* (2013.01); *H01R 13/4368* (2013.01); *H01R 13/4223* (2013.01); *H01R 13/5202* (2013.01)

(58) Field of Classification Search

CPC .. H01R 13/514; H01R 13/516; H01R 13/502; H01R 13/506; H01R 13/508

USPC ..... 439/357, 291, 712, 713, 715, 716, 718, 439/752

See application file for complete search history.

(56) References Cited

U.S. PATENT DOCUMENTS 5,234,353 A * 8/1993 Scholz ..... H01R 13/28 439/289
5,362,261 A * 11/1994 Puerner ..... H01R 13/4364 439/689

(Continued)

FOREIGN PATENT DOCUMENTS

JP 2008203616 A 9/2008
JP 2010247564 A 11/2010

*Primary Examiner* — Vanessa Girardi
(74) *Attorney, Agent, or Firm* — Dinsmore & Shohl LLP

(57) ABSTRACT

A connector assembly includes a male housing having at least one coaxial cavity and terminal cavities. At least one female housing is shaped to be disposed in the male housing when in a connected position. The at least one female housing includes a corresponding coaxial cavity relative to the male housing and corresponding terminal cavities relative to the male housing. At least one front loaded male terminal position assurance structure is disposed in the male housing. At least one front loaded female terminal position assurance structure is connected to the at least one female housing. The front loaded male and female terminal position assurance structures lock coaxial connections and terminal connections within the male and female housings when in the connected position.

25 Claims, 9 Drawing Sheets

(56) References Cited

U.S. PATENT DOCUMENTS

| | | | | | |
|---|---|---|---|---|---|
| 5,584,713 | A * | 12/1996 | Kato | H01R 13/703 | 200/51.1 |
| 5,718,592 | A * | 2/1998 | Hosler, Sr. | H01R 24/50 | 439/63 |
| 6,183,299 | B1 * | 2/2001 | Ward | H01R 13/4223 | 439/595 |
| 2008/0102666 | A1 | 5/2008 | Yamashita | | |

* cited by examiner

WIRE CONNECTOR WITH INTEGRATED COAXIAL CONNECTION AND FRONT LOADED TERMINAL POSITION ASSURANCE STRUCTURES

CROSS-REFERENCE TO RELATED APPLICATIONS

This application claims priority of U.S. Provisional Application No. 62/212,914 filed Sep. 1, 2015, the contents of which are incorporated herein by reference.

FIELD OF THE INVENTION

The invention relates to terminal connectors and with more particularity to multi-cavity terminal connectors including coaxial and terminal cavities.

BACKGROUND OF THE INVENTION

In the prior art, coaxial connections are separate from terminal connections in connector assemblies. Typically, the male coaxial component gets locked into a female component and then connects to a clip slot that may attach to a connector or a wire harness. There is therefore a need for a wiring connector that has a compact packaging space requirement that includes both terminal connectors and a coaxial terminal connection. There is also a need for a wiring connector that includes both terminal connectors and a coaxial terminal connection with a terminal position assurance structure that locks both the terminal and coaxial connections.

SUMMARY OF THE INVENTION

In one aspect, there is disclosed a connector assembly that includes a male housing having at least one coaxial cavity and terminal cavities. At least one female housing is shaped to be disposed in the male housing when in a connected position. The at least one female housing includes a corresponding coaxial cavity relative to the male housing and corresponding terminal cavities relative to the male housing. At least one front loaded male terminal position assurance structure is disposed in the male housing. At least one front loaded female terminal position assurance structure is connected to the at least one female housing. The front loaded male and female terminal position assurance structures lock coaxial connections and terminal connections within the male and female housings when in the connected position.

In another aspect, there is disclosed a connector assembly that includes a male housing having at least one coaxial cavity and terminal cavities. At least one female housing is shaped to be disposed in the male housing when in a connected position. The at least one female housing includes a corresponding coaxial cavity relative to the male housing and corresponding terminal cavities relative to the male housing. The coaxial cavity of the male and female housing includes a cam structure formed thereon aligning and holding a coaxial terminal within the coaxial cavity.

In another aspect, there is disclosed a connector assembly that includes a male housing including at least one coaxial cavity and terminal cavities. The male housing includes lance structures formed about the coaxial cavity. At least one female housing is shaped to be disposed within the male housing when in a connected position. The at least one female housing includes a corresponding coaxial cavity relative to the male housing and corresponding terminal cavities relative to the male housing. The female housing includes lance structures formed about the coaxial cavity. At least one front loaded male terminal position assurance structure is disposed in the male housing. The male terminal position assurance structure includes wedges formed therein corresponding to a position of the coaxial cavity. At least one front loaded female terminal position assurance structure is connected to the at least one female housing. The female terminal position assurance structure includes wedges formed therein corresponding to a position of the coaxial cavity. When a coaxial terminal is inserted into the coaxial cavity of the male or female housing the lances of the male or female housing and the wedges of the male or female terminal position assurance structure interact locking the coaxial terminal into position.

DETAILED DESCRIPTION OF THE PREFERRED EMBODIMENTS

Figure 1:
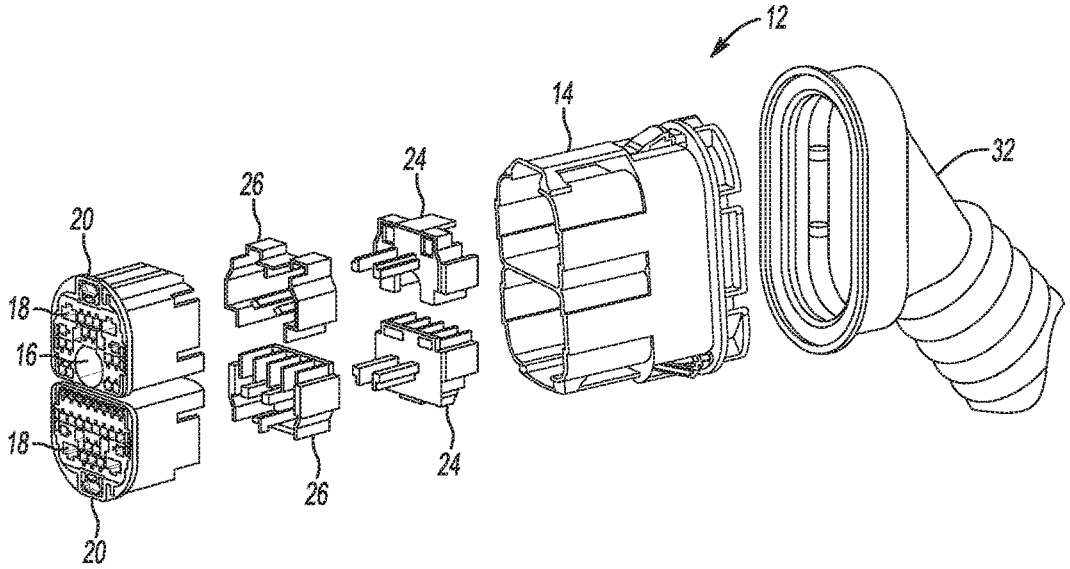
FIG. 1 is an exploded perspective view of a connector assembly.

Referring to the various figures, there is detailed a connector assembly 12 that may be utilized for wire routing through vehicle openings particularly through vehicle doors. The connector assembly 12 may include a male housing 14 that includes at least one coaxial cavity 16 and terminal cavities 18. At least one female housing 20 is shaped to be disposed in the male housing 14 when in a connected position. The at least one female housing 20 includes a corresponding coaxial cavity 16 relative to the male housing 14 and corresponding terminal cavities 18 relative to the male housing 14. At least one front loaded male terminal position assurance structure 24 is disposed in the male housing 14. At least one front loaded female terminal position assurance structure 26 is connected to the at least one female housing 20. The front loaded male and female terminal position assurance structures 24, 26 lock coaxial connections 28 and terminal connections 30 within the male and female housings 14, 20 when in the connected position.

Figure 2:
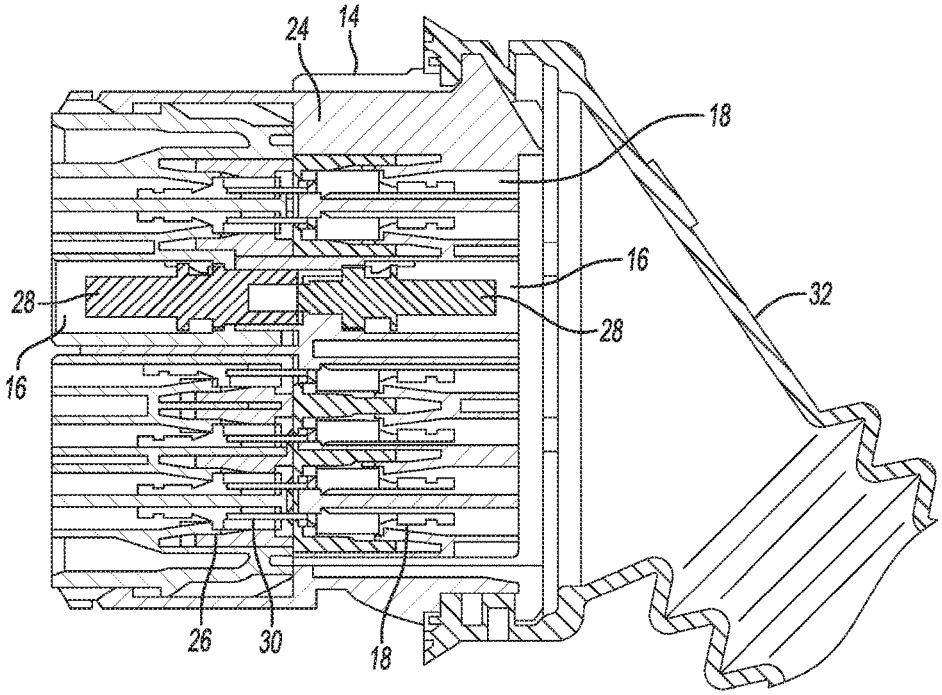
FIG. 2 is a cutaway side view of a connector assembly.
Figure 3A:
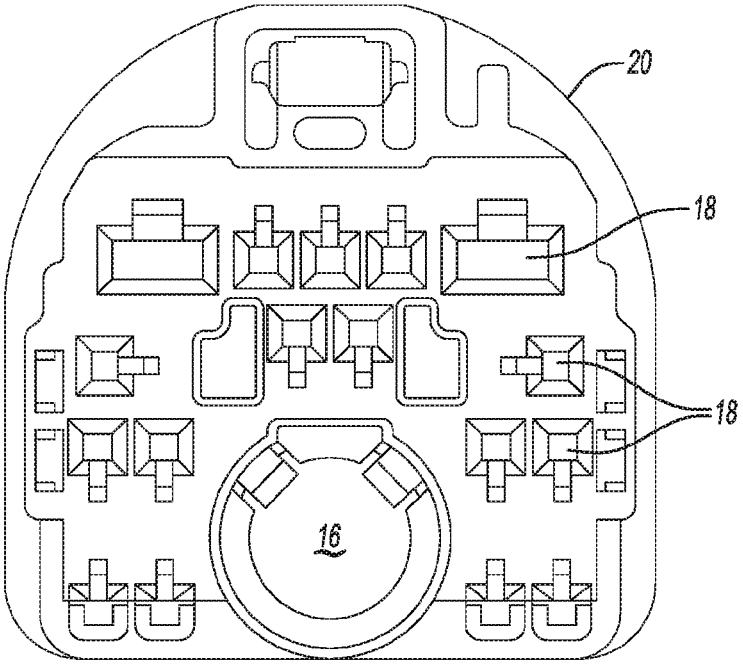
FIG. 3A is an end view of a female housing.
Figure 3B:
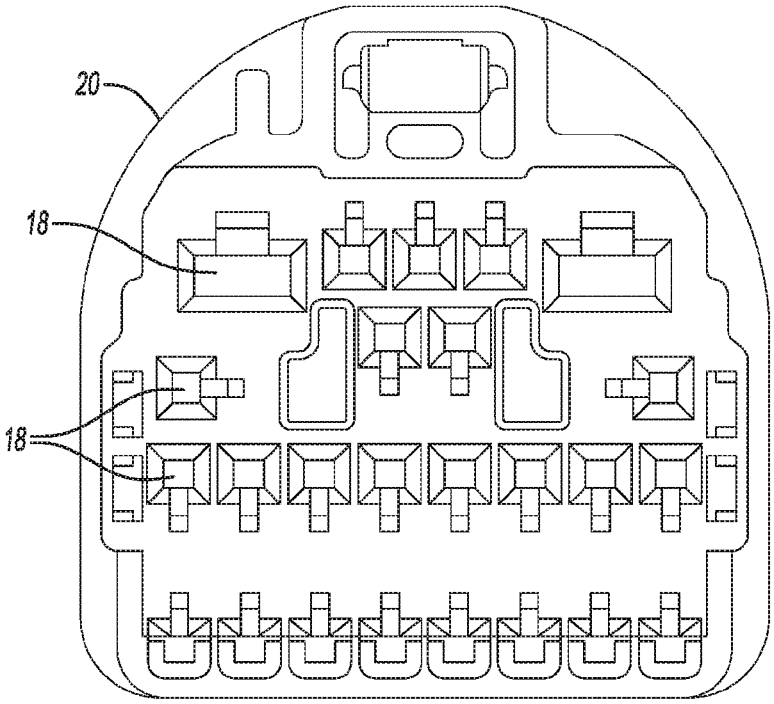
FIG. 3B is an end view of a female housing.

In the depicted embodiments of FIGS. 1-3, the at least one female housing 20 includes two female housings 20. The female housings 20 may have differing numbers of terminal connections 30 with one including a coaxial cavity 16 in the depicted embodiment. The male housing 14 may be formed of a unitary structure and receives the two female housings 20. In this manner, the male housing 14 may be utilized in various vehicle platforms by switching the number of terminals within the female housings 20 while reusing the common male housing 14. Additionally, in the depicted embodiments of FIGS. 1-2 and 4, two male and female terminal position assurance structures 24, 26 are provided. It should be realized that various numbers of terminal connections or terminals 30 may be provided in the female housing 20 which will also have a corresponding male housing 14 and will also include a corresponding number of terminal position structures in the male and female terminal position assurance structures 24, 26. In one aspect, the connector assembly 12 may further include a grommet 32 attached to the male housing 14, as best seen in FIGS. 1 and 2.

In the depicted embodiments, the connector assembly 12 includes a coaxial cavity 16 and additional terminal cavities 18. The terminals may include various types of systems such as a Tyco Gen Y and FCI Apex type terminals. Additionally, in the depicted embodiments the two female housings 20 allow potential flexibility in design with differing numbers of terminals. In the depicted embodiment of FIG. 3A there is detailed an 18-terminal connector including a coaxial cavity 16 for receiving a coaxial terminal or connection 28 and 18 terminal connections 30 while in FIG. 3B, there is depicted a 25-terminal connector that does not include a coaxial cavity 16. It should be realized that various numbers of terminal connections 30 and coaxial connections 28 may be included.

Figure 5:
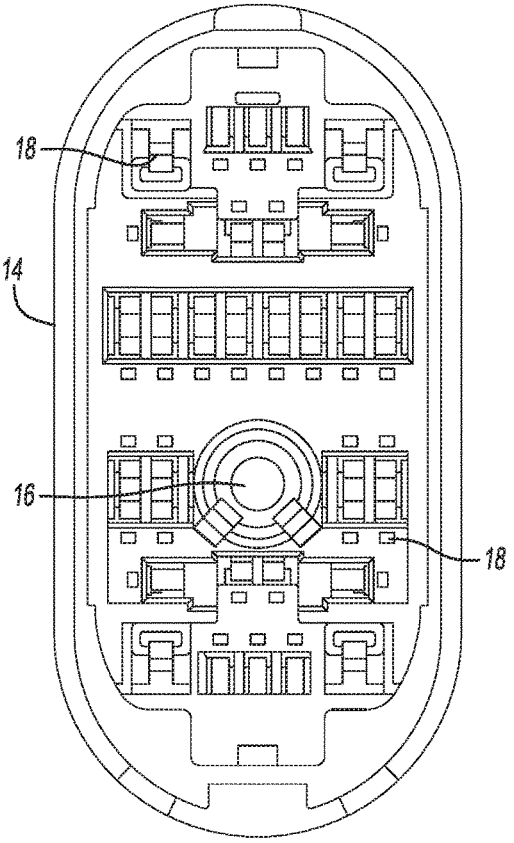
FIG. 5 is an end view of a male housing.

Referring to FIG. 5, the male housing 14 includes a corresponding number of coaxial cavities 16 and terminal cavities 18 that align with the female housing 20 cavities as described above.

Figure 6:
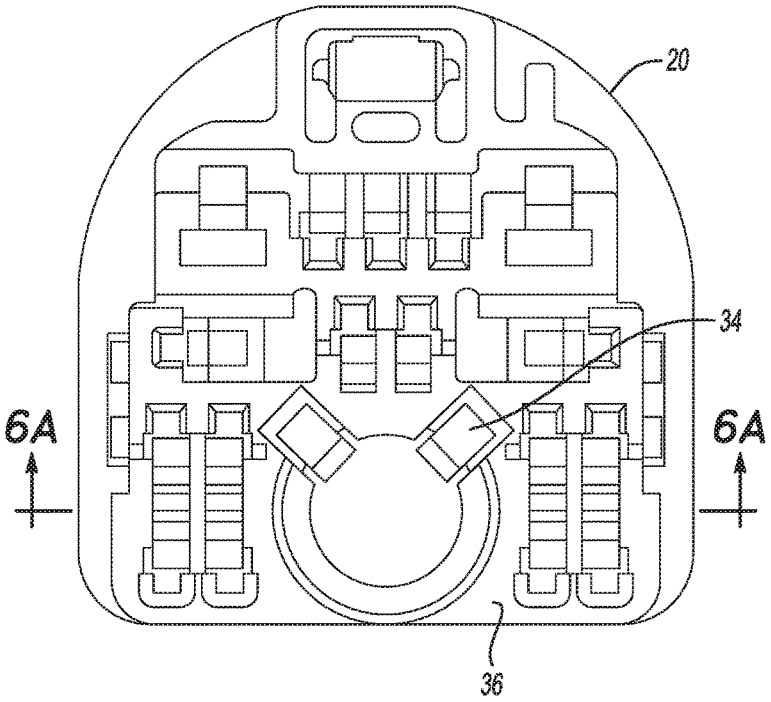
FIG. 6 is an end view of the female housing structure detailing the lance structures.
Figure 6A:
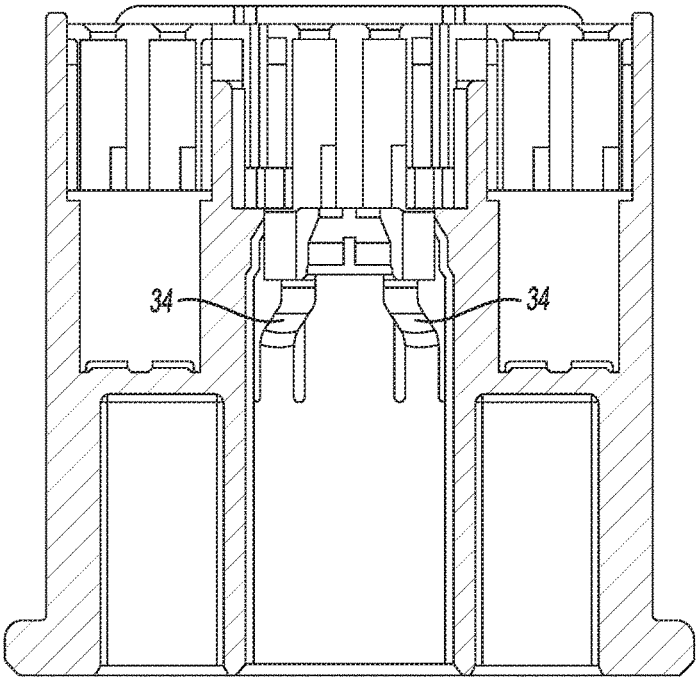
FIG. 6A is a sectional view of FIG. 6.
Figure 7:
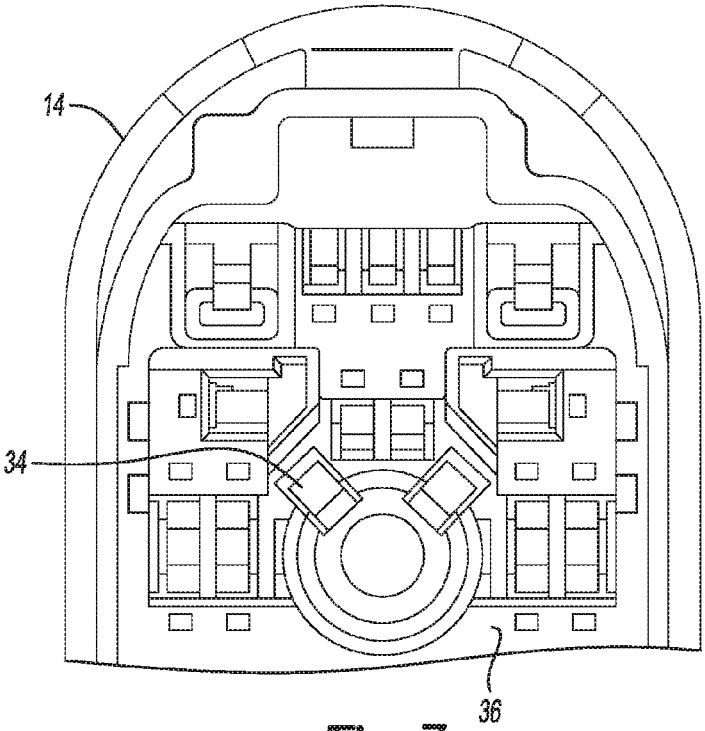
FIG. 7 is an end view of the male housing structure detailing the lance structures.

Referring to FIGS. 6 and 6A, the female housing 20 includes lance structures or lances 34 formed about the coaxial cavity 16. In one aspect, the lance structures 34 extend from a face 36 of the female housing 20 and are positioned radially about the coaxial cavity 16. In the depicted embodiment, two lance structures 34 are formed on the female housing 20. Similarly, as shown in FIG. 7, the male housing 14 includes lance structures 34 formed radially about the coaxial cavity 16 and again two lance structures 34 are shown in the depicted embodiment.

Figure 6B:
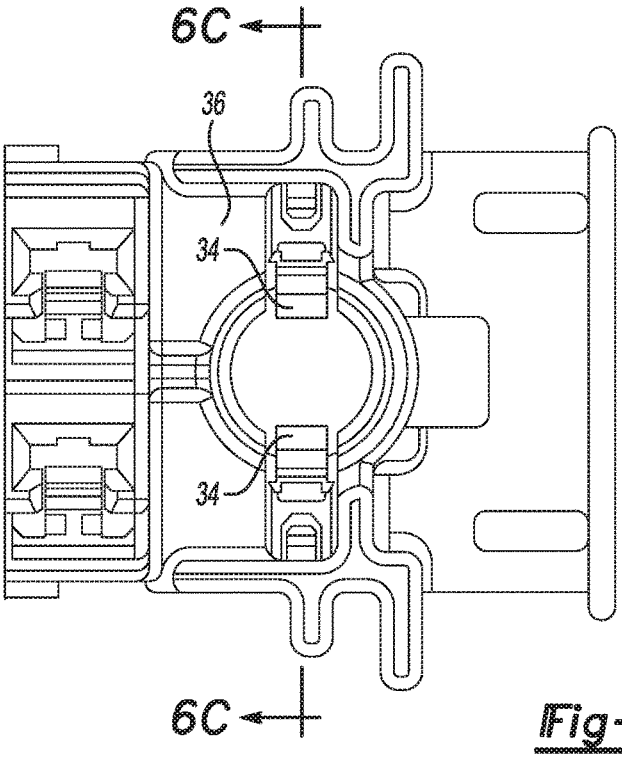
FIG. 6B is a partial end view of the female housing structure detailing the lance structures.
Figure 6C:
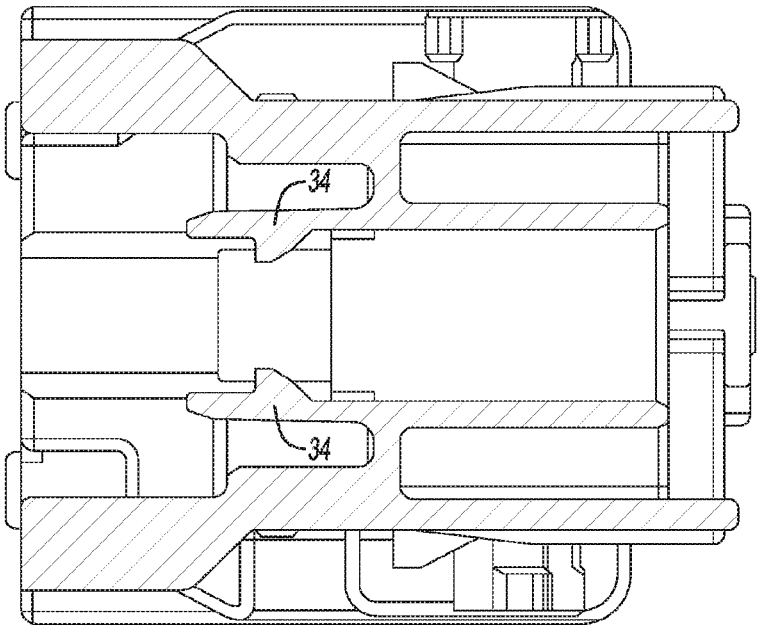
FIG. 6C is a sectional view of FIG. 6B.

Referring to FIGS. 6B and 6C there is shown another position of the lances 34 on the female housing 20. The lances 34 as shown are positioned so as to be diametrically opposed to each other wherein the biasing force of one lance 34 is countered by the biasing force of the opposing lance 34. Accordingly, the coaxial terminal 28 is centered in the coaxial cavity 16, which helps ensure the coaxial terminal 28 is retained therein.

Figure 4A:
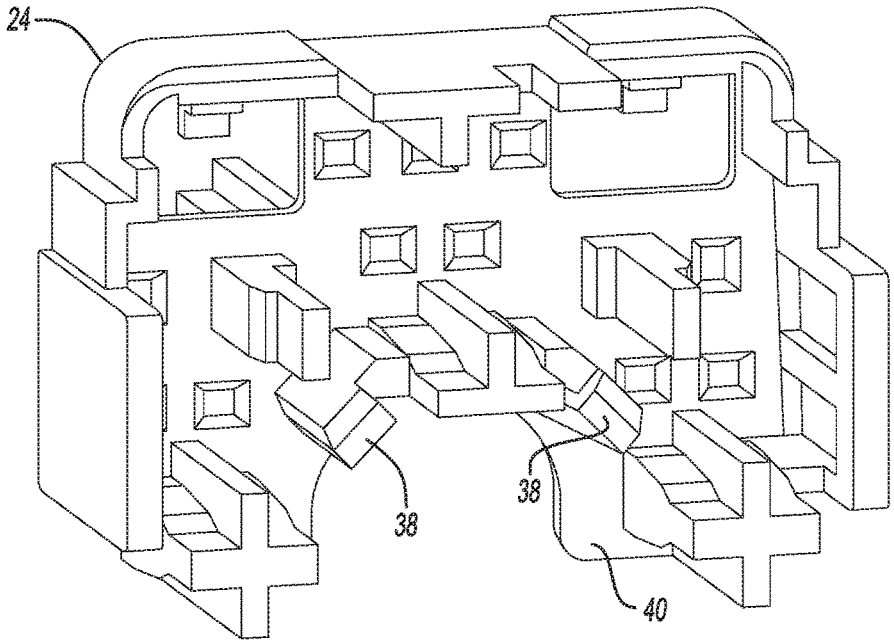
FIG. 4A is partial perspective view of the male terminal position assurance structure detailing the wedges formed thereon.
Figure 4B:
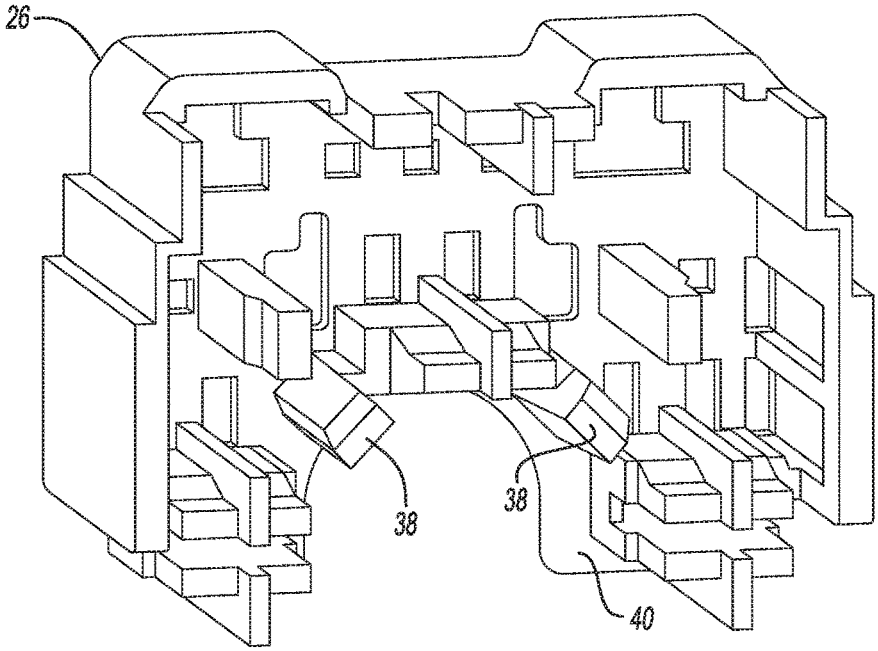
FIG. 4B is partial perspective view of the female terminal position assurance structure detailing the wedges formed thereon.

Referring to FIGS. 4A and 4B, the male terminal position assurance structures 24 and the female terminal position assurance structures 26 include wedges 38 formed thereon that correspond to a position of the coaxial cavity 16. In the depicted embodiment, the terminal position assurance structures 24, 26 include two wedges 38 formed thereon and extend from a face 40 of the terminal position assurance structures 24, 26. In one aspect, the wedges 38 interact with the lances 34 of the housings 14, 20 as will be described in more detail below.

Figure 8:
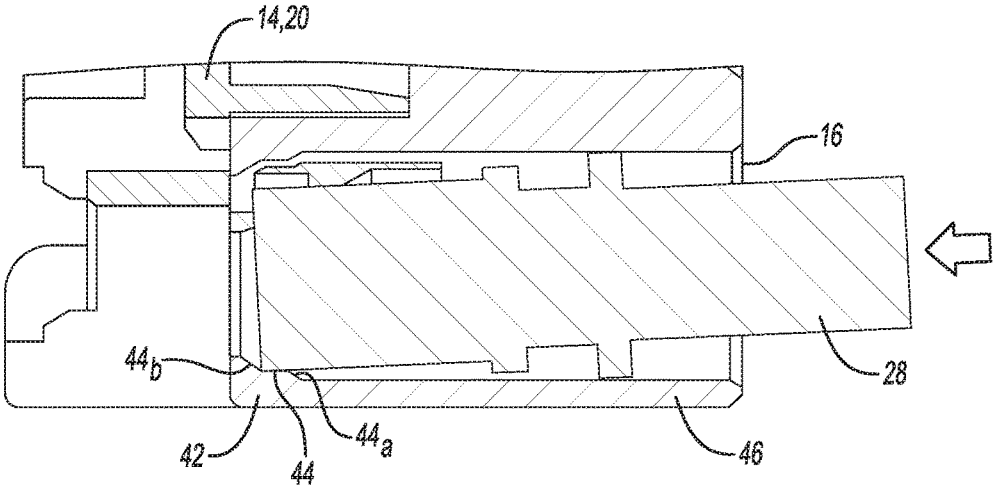
FIG. 8 is a partial sectional view detailing the coaxial cavity and insertion of a coaxial terminal.

Referring to FIG. 8, the coaxial cavity 16 of the male and female housings 14, 20 includes a cam structure 42 formed thereon that facilitates insertion and location of a coaxial terminal 28 into the coaxial cavity 16 and provides a temporary positioning of the coaxial terminal 28 before the terminals are locked in position as will be described in more detail below. As shown in the figure, the cam structure 42 may include at least one or multiple ramps or angles 44 formed on the surface 46 of the cavity 16 to facilitate insertion and location of the coaxial terminal 28 even when the terminal position assurance structures 24, 26 are in a pre-staged or removed position. As the coaxial terminal 28 is inserted into the cavity, it travels on the surface 46 and continues to a first ramp 44*a* which aligns and temporarily holds the coaxial terminal 28 in position within the cavity 16. As the coaxial terminal 28 is further inserted into the cavity it contacts a second ramp 44*b* that further aligns the coaxial terminal 28 within the cavity and temporarily holds the coaxial terminal in position.

Figure 9:
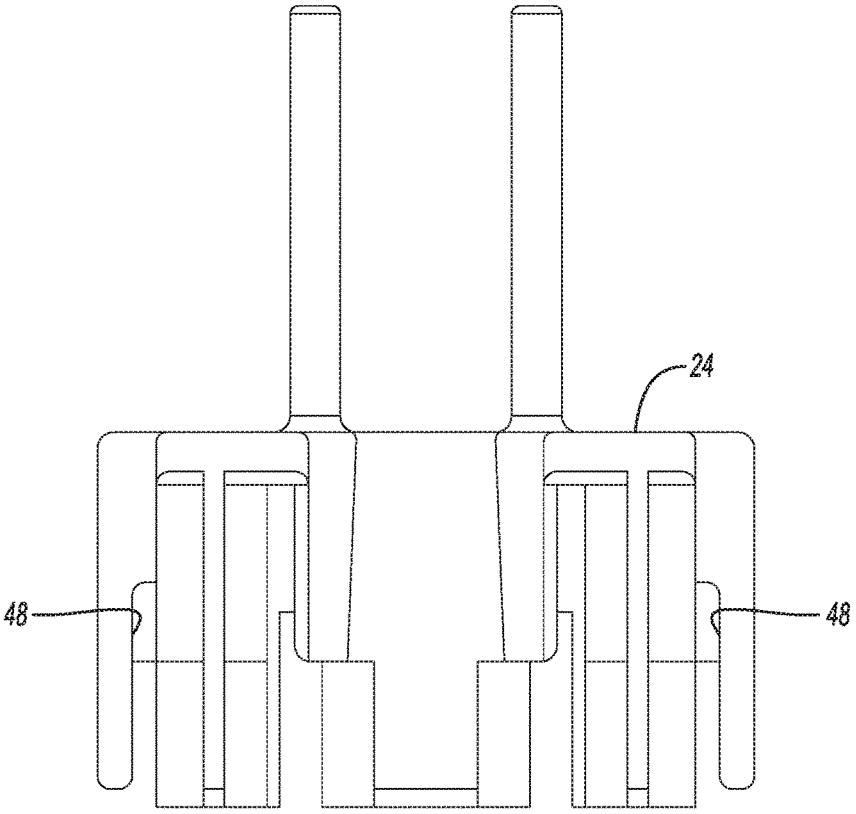
FIG. 9 is a top view of a male terminal position assurance structure including slots formed therein.

Referring to FIG. 9, the male terminal position assurance structure 24 includes notches 48 formed thereon that control an insertion force connecting the male terminal position assurance structure 24 to the male housing 14. In this manner, a force can be regulated for connecting the male terminal position assurance structure 24 to the male housing 14 to assure fatigue or other types of failures do not occur.

Figure 10A:
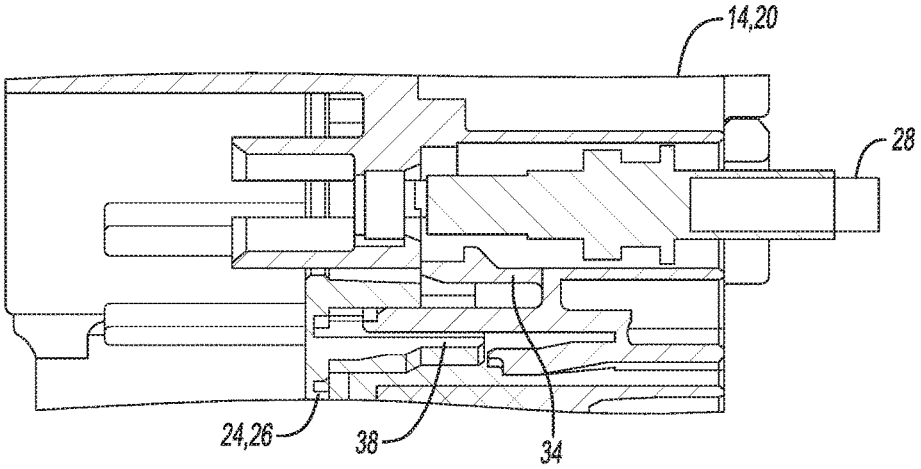
FIG. 10A is a view detailing insertion of a coaxial terminal and the interaction between the lance and wedges of the housing and terminal position assurance structure.
Figure 10B:
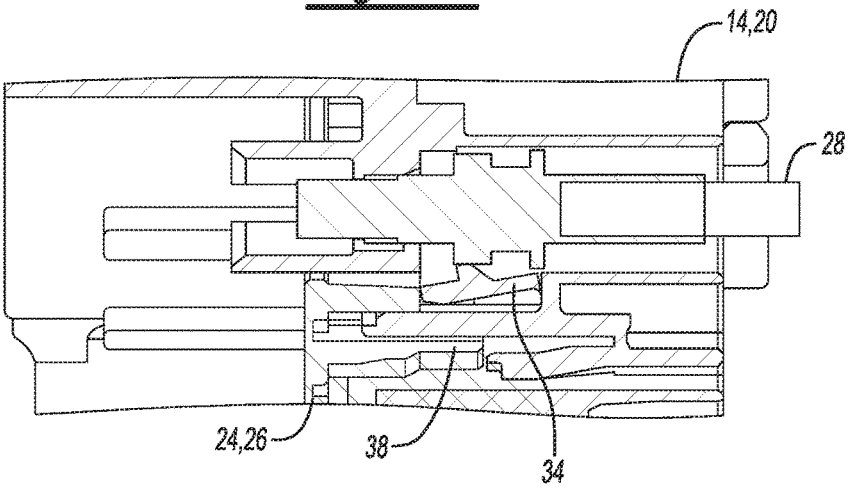
FIG. 10B is a view detailing insertion of a coaxial terminal and the bending of the lance.
Figure 10C:
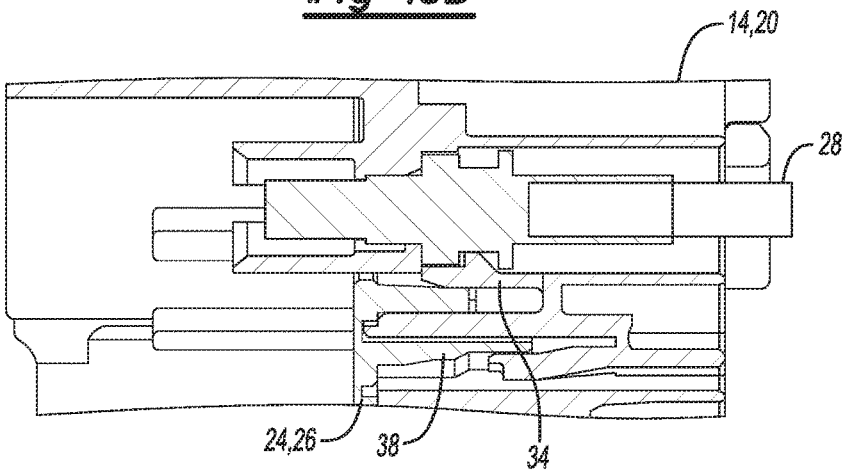
FIG. 10C is a view detailing insertion of a coaxial terminal and the interaction between the lance and wedges of the housing and terminal position assurance structure when locked.

Referring to FIGS. 10A-C, there is shown views of the interaction of a coaxial terminal 28 and housing 14 and terminal position assurance structure 24. When a coaxial terminal 28 is inserted into the coaxial cavity 16 of either the male or female housing 14, 20, the lances 34 of the housing 14, 20 and the wedges 38 of the terminal position assurance structures 24, 26 interact locking the coaxial terminal 28 into position. When the coaxial terminal 28 is inserted into the coaxial cavity 16 of the male or female housing 14, 20, the lances 34 begin in a starting position (FIG. 10A) and then bend allowing the terminal 28 to be pushed into the cavity (FIG. 10B). Next the lances 34 return to the starting position as the wedges 38 of the terminal position assurance structure 24, 26 slide beneath the lances 34 preventing the lance 34 from bending and locking the coaxial terminal 28 into position (FIG. 10C).

Figure 11:
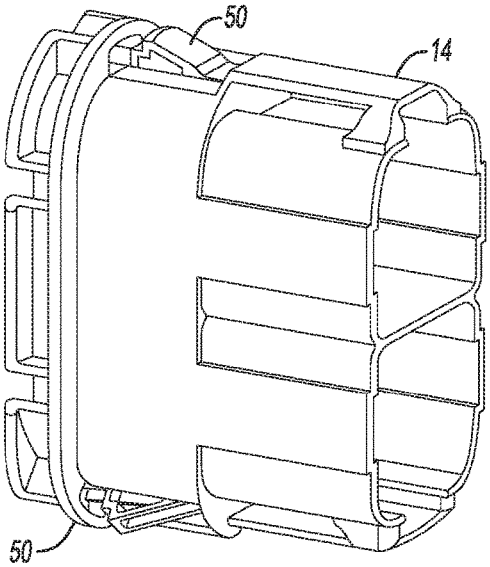
FIG. 11 is a partial perspective view of a male housing including panel lock members and a bridge and sidewall structure of the male housing.
Figure 12A:
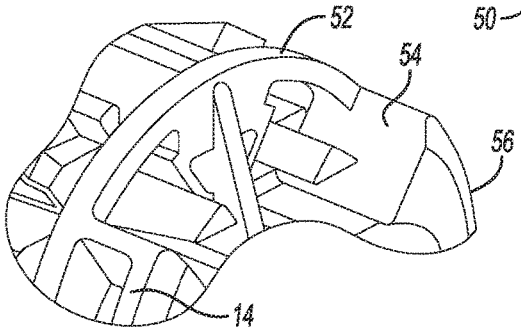
FIG. 12*a* is a partial perspective view of a male housing including panel lock members and a bridge and sidewall structure of the male housing.
Figure 12B:
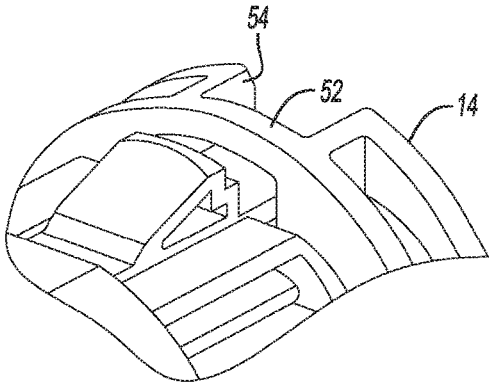
FIG. 12*b* is a view of FIG. 12*a* taken from the opposite side.

Referring to FIG. 11, the connector assembly 12 includes a male housing 14 having a plurality of panel lock members 50 locking the male housing 14 into an opening formed in a panel. The male housing 14 includes a bridge structure 52 formed thereon proximate the panel locks 50 preventing breakage of the panel locks 50. Additionally, the male housing 14 includes sidewalls 54 formed thereon proximate the panel locks 50 preventing deflection of the panel locks 50. Further, as best shown in FIGS. 12*a* and 12*b*, the panel locks 50 extend toward a rear face 56 of the housing 14 less than flush relative to the rear face 56 to minimize snagging of the panel lock members 50.

Figure 13:
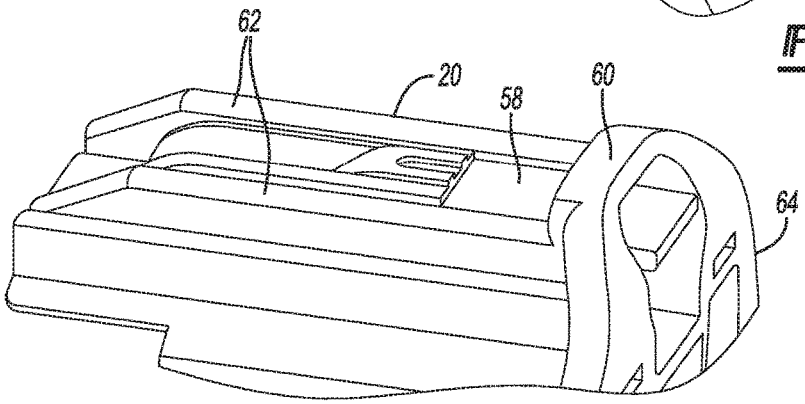
FIG. 13 is a partial perspective view of a female housing detailing the connector lock member including a bridge structure and sidewalls.

Referring to FIG. 13, the female housing 20 includes a connector lock 58 locking the female and male housings 14, 20. The female housing 20 includes a bridge structure 60 formed thereon proximate the connector lock 58 preventing breakage of the connector lock 58. Additionally, the female housing 20 includes sidewalls 62 formed thereon proximate the connector lock 58 to prevent deflection of the connector lock 58. Additionally, the connector lock 58 extends toward a rear face 64 of the female housing 20 less than flush relative to the rear face 64 minimizing snagging of the connector lock 58.

The above examples and embodiments are for illustrative purposes only and changes, modifications, and the like will be apparent to those skilled in the art and yet still fall within the scope of the invention. As such, the scope of the invention is defined by the claims.

We claim:

1. A connector assembly comprising:

a male housing including at least one coaxial cavity and terminal cavities;

at least one female housing shaped to be disposed in the male housing when in a connected position, the at least one female housing including a corresponding coaxial cavity relative to the male housing and corresponding terminal cavities relative to the male housing;

at least one front loaded male terminal position assurance structure disposed in the male housing;

at least one front loaded female terminal position assurance structure connected to the at least one female housing; and wherein the front loaded male and female terminal position assurance structures lock coaxial connections and the terminal connections within the male and female housings when in the connected position.

2. The connector assembly of claim 1 wherein the at least one female housing includes two female housings.

3. The connector assembly of claim 1 further including a grommet attached to the male housing.

4. The connector assembly of claim 1 wherein the male housing includes lance structures formed radially about the coaxial cavity.

5. The connector assembly of claim 1 wherein the male housing includes lance structures formed diametrically opposed to each other about the coaxial cavity.

6. The connector assembly of claim 1 wherein the male terminal position assurance structure includes wedges formed therein corresponding to a position of the coaxial cavity.

7. The connector assembly of claim 1 wherein the female housing includes lance structures formed radially about the coaxial cavity.

8. The connector assembly of claim 1 wherein the female housing includes lance structures formed diametrically opposed to each other about the coaxial cavity.

9. The connector assembly of claim 1 wherein the female terminal position assurance structure includes wedges formed therein corresponding to a position of the coaxial cavity.

10. The connector assembly of claim 1 wherein the male terminal position assurance structure includes notches formed thereon controlling an insertion force connecting the male terminal position assurance structure to the male housing.

11. The connector assembly of claim 1 wherein the male housing includes a plurality of panel lock members locking the male housing into an opening and wherein the male housing includes a bridge structure formed thereon proximate the panel locks preventing breakage of the panel locks.

12. The connector assembly of claim 1 wherein the male housing includes a plurality of panel lock members locking the male housing into an opening and wherein the male housing includes sidewalls formed thereon proximate the panel locks preventing deflection of the panel locks.

13. The connector assembly of claim 1 wherein the male housing includes a plurality of panel lock members locking the male housing into an opening and wherein the panel locks extend toward a rear face of the housing less than flush relative to the rear face minimizing snagging of the panel lock members.

14. The connector assembly of claim 1 wherein the female housing includes a connector lock member locking the female and male housings and wherein the female housing includes a bridge structure formed thereon proximate the connector lock preventing breakage of the connector lock.

15. The connector assembly of claim 1 wherein the female housing includes a connector lock member locking the female and male housings and wherein the female housing includes sidewalls formed thereon proximate the connector lock preventing deflection of the connector lock.

16. The connector assembly of claim 1 wherein the female housing includes a connector lock member locking the female and male housings and wherein the connector lock extends toward a rear face of the housing less than flush relative to the rear face minimizing snagging of the connector lock member.

17. The connector assembly of claim 1 wherein the coaxial cavity of the male and female housing includes a cam structure formed thereon aligning and holding a coaxial terminal within the coaxial cavity.

18. The connector assembly of claim 17 wherein the cam structure includes at least one ramp formed on a surface of the cavity holding and locating the coaxial terminal within the coaxial cavity.

19. The connector assembly of claim 1 wherein when a coaxial terminal is inserted into the coaxial cavity of the male housing lance structures of the male housing and wedges of the male terminal position assurance structure interact locking the coaxial terminal into position.

20. The connector assembly of claim 19 wherein when a coaxial terminal is inserted into the coaxial cavity of the male housing the lance structures begin in a starting position and then bend allowing the terminal to be pushed into the cavity and the lance structures then return to the starting position as the wedges of the male terminal position assurance structure slide beneath the lance structures preventing the lance structures from bending and locking the coaxial terminal into position.

21. The connector assembly of claim 1 wherein when a coaxial terminal is inserted into the coaxial cavity of the female housing, lance structures of the female housing and wedges of the female terminal position assurance structure interact locking the coaxial terminal into position.

22. The connector assembly of claim 21 wherein when a coaxial terminal is inserted into the coaxial cavity of the female housing the lance structures begin in a starting position and then bend allowing the terminal to be pushed into the cavity and the lance structures then return to the starting position as the wedges of the female terminal position assurance structure slide beneath the lance structures preventing the lance structures from bending and locking the coaxial terminal into position.

23. A connector assembly comprising:

a male housing including at least one coaxial cavity and terminal cavities;

at least one female housing shaped to be disposed in the male housing when in a connected position, the at least one female housing including a corresponding coaxial cavity relative to the male housing and corresponding terminal cavities relative to the male housing;

wherein the coaxial cavity of the male and female housing includes a cam structure formed thereon aligning and holding a coaxial terminal within the coaxial cavity.

24. The connector assembly of claim 23 wherein the cam structure includes at least one ramp formed on a surface of the cavity holding and locating the coaxial terminal within the coaxial cavity.

25. A connector assembly comprising:

a male housing including at least one coaxial cavity and terminal cavities, the male housing includes lance structures formed about the coaxial cavity;

at least one female housing shaped to be disposed in the male housing when in a connected position, the at least one female housing including a corresponding coaxial cavity relative to the male housing and corresponding terminal cavities relative to the male housing, the female housing includes lance structures formed about the coaxial cavity;

at least one front loaded male terminal position assurance structure disposed in the male housing, the male terminal position assurance structure including wedges formed therein corresponding to a position of the coaxial cavity;

at least one front loaded female terminal position assurance structure connected to the at least one female housing, the female terminal position assurance structure includes wedges formed therein corresponding to a position of the coaxial cavity; and wherein when a coaxial terminal is inserted into the coaxial cavity of the male or female housing the lances of the male or female housing and the wedges of the male or female terminal position assurance structure interact locking the coaxial terminal into position.

* * * * *